US008911276B2

(12) United States Patent
Kim et al.

(10) Patent No.: US 8,911,276 B2
(45) Date of Patent: Dec. 16, 2014

(54) ASSEMBLING TOY BLOCK WITH EMBEDDED MAGNETS

(75) Inventors: Deok Yeon Kim, Seoul (KR); Sung Tae Kwon, Goyang-si (KR)

(73) Assignee: Valution Inc., Seoul (KR)

( * ) Notice: Subject to any disclaimer, the term of this patent is extended or adjusted under 35 U.S.C. 154(b) by 160 days.

(21) Appl. No.: 13/576,850

(22) PCT Filed: Jan. 28, 2011

(86) PCT No.: PCT/KR2011/000637

§ 371 (c)(1),
(2), (4) Date: Aug. 23, 2012

(87) PCT Pub. No.: WO2011/099716

PCT Pub. Date: Aug. 18, 2011

(65) Prior Publication Data

US 2012/0322339 A1 Dec. 20, 2012

(30) Foreign Application Priority Data

Feb. 2, 2010 (KR) ..... 10-2010-0010195

(51) Int. Cl.
*A63H 33/04* (2006.01)
*A63H 33/08* (2006.01)

(52) U.S. Cl.
CPC ..... *A63H 33/08* (2013.01); *A63H 33/046* (2013.01)
USPC ..... 446/92

(58) Field of Classification Search
USPC ..... 446/85, 92, 108, 124
See application file for complete search history.

(56) References Cited

U.S. PATENT DOCUMENTS

| | | | | |
|---|---|---|---|---|
| 6,969,294 | B2 * | 11/2005 | Vicentelli | 446/92 |
| 7,255,624 | B2 * | 8/2007 | Daftari | 446/92 |
| 7,892,065 | B2 * | 2/2011 | Vicentelli | 446/92 |
| 2005/0197038 | A1 * | 9/2005 | Tusacciu | 446/92 |

FOREIGN PATENT DOCUMENTS

| | | |
|---|---|---|
| KR | 1020030065059 | 8/2003 |
| KR | 2020090004459 | 5/2009 |
| KR | 100915516 | 8/2009 |
| KR | 1020100129395 | 12/2010 |

* cited by examiner

*Primary Examiner* — John Ricci
(74) *Attorney, Agent, or Firm* — IPLA P.A.; James E. Bame

(57) ABSTRACT

Provided is a toy building block which uses magnets, and which is a combination building block toy and teaching instrument with embedded magnets, wherein on each of the four edges of an upper frame (2) and lower frame (3), an inward-facing insertion aperture (6) is formed to connect internally to a central hollow portion (7), a magnetic ball (8) is inserted in the respective central hollow portions (7), and a projecting protrusion on the top and bottom of four pillars are inserted in the respective insertion apertures; and inward-facing projecting protrusions (21, 22, 23, 24), (25, 26, 27, 28) on an upper frame (20), lower frame (30), and pillars (40, 41, 42, 43), are respectively inserted in insertion grooves (23', 24', 27', 28') and (23*a*, 23*b*, 28*a*, 18*b*) on respective rails (9, 9') (11, 11'), (9*a*, 9*b*, 11*a*, 11*b*) to assemble blocks (1) (1') (1") (1'"), which are interconnected and used as a building block toy, or a random number of blocks (1) (10) (50) are stacked and assembled for observing the movement of a ball (8*a*) that rolls on a rail.

2 Claims, 7 Drawing Sheets

ASSEMBLING TOY BLOCK WITH EMBEDDED MAGNETS

BACKGROUND OF THE INVENTION

The present invention relates to an assembling toy block with embedded magnets that is assembled into a regular hexahedral frame and has magnetic balls, such as ball bearings, embedded in edges of upper and lower frames of the block such that the magnets embedded in the edges can overcome polarity between the magnets, which is generated when the blocks are assembled, by rotation, that allows a user to see movements of the magnetic balls, and that helps to develop children's creativity and intelligence while children accumulate, assemble and disassemble three-dimensional building blocks in various ways.

There are many assembling toy building blocks, for instance, Korean Patent No. 10-0430854 discloses a prefabricate toy block set, Korean Patent No. 10-0457305 discloses a rotational magnet joining device and an assembling toy having the same, Korean Patent No. 10-0496129 discloses an assembling toy blocks, Korean Utility Model Registration No. 20-375134 discloses a block set with magnets, and Korean Utility Model Registration No. 20-0265633 discloses an assembling teaching tool for infants.

The above prior arts will be described in more detail. First, the assembling toy block set disclosed in Korean Patent No. 10-0430854 includes a concavo-convex structure mounted on opposed and facing surfaces, a plurality of unit blocks separably assembled by gravitation of magnets with opposite polarity, a plurality of block links and block wheels. The assembling toy block set enables infants or children to enjoy playing with blocks because the blocks provide good joining force. Second, assembling toy blocks disclosed in Korean Patent No. 10-0496129 includes a plurality of parts of polyhedral shapes having joining faces in such a way as to be joined with joining faces of other parts. The parts respectively have magnetic portions formed on the joining faces, so that the block is assembly by magnetic force between the magnetic portion of the part and the magnetic portion of other part, and in this instance, a plurality of magnets are inserted and fixed on each face of the polyhedron.

Third, the rotational magnet joining device and the assembling toy having the same disclosed in Korean Patent No. 10-0457305 have 85 claims, but the assembling toy is similar in structure with the above-mentioned assembling toys, but there is a greater or less difference in that the magnets are formed in a ball bearing shape.

Fourth, the block set with magnets disclosed in Korean Utility Model Registration No. 20-375134 includes a magnet mounted at an area and a block unit of a ring shape with a predetermined width.

Fifth, the assembling teaching tool for infants disclosed in Korean Utility Model Registration No. 20-0265633 includes a plurality of separable bodies divided equally from a completed body, which has a predetermined width and size, at a fixed percentage, and joining means mounted at a predetermined position on an outer face of the separable bodies in order to keep a mutually fixed condition when the separable bodies are joined together. In order to develop intellectual curiosity and intelligence while infants or children join the separable bodies divided equally at the fixed percentage, magnets are inserted and mounted on faces of the hexahedral body. The toy blocks according to the prior arts are all formed by the magnets fixed or inserted on each face of the body like a dice. In all of toys or teaching materials till now, the magnets are fixed, inserted or embedded at fixed positions not to be seen from the outside, and the shapes of the blocks are formed by the magnet's magnetic force

SUMMARY OF THE INVENTION

Differently from various toys or teaching tools according to the prior arts, the present invention provides an assembling toy block with embedded magnets that includes an upper frame, a lower frame and four pillars which are assembled into a regular hexahedral block, eight spherical magnets of a ball bearing shape inserted into each edge of the upper and lower frames in such a fashion that assembled blocks are joined together in a wanted shape by the spherical magnets of various three-dimensional shapes in order to overcome polarity between the magnets generated when the blocks are joined together. Moreover, a user can see a rolling flow of the spherical magnet by polarity while the spherical magnets of the upper and lower frames and the pillars all have inward-facing protrusions which are inserted into insertion apertures formed in the small rails and curved rails. Accordingly, the present invention has been made in an effort to solve the above-mentioned problems occurring in the prior arts, and it is an object of the present invention to provide an assembling toy block with embedded magnets, which enables the user to assemble and accumulate the blocks in various shapes and forms and helps to develop infants' and children's intelligence and creativity.

To achieve the above objects, the present invention provides an assembling toy block with embedded magnets that includes: hexahedral upper frame and lower frame; insertion apertures formed at four edges of the inner faces of the upper and lower frames; and hollow portions respectively formed below the insertion apertures. Magnetic balls (spherical magnets) are respectively inserted into the hollow portions in such a way as to be freely moved; and protrusions projectingly formed on upper and lower ends of four pillars and respectively inserted and assembled into the insertion apertures of the upper and lower frames, so that a regular hexahedral block is completed.

Here, when the protrusions formed at the upper and lower ends of the pillars are inserted into the insertion apertures of the upper and lower frames, the pillars get in close contact with the upper and lower frames without falling out. If the joining state is in an incomplete state, adhesives may be used to firmly bond them. When the protrusions are inserted into the insertion apertures, the spherical magnets inserted into the hollow portions are freely movable, and is not interrupted in movement.

Moreover, the blocks according to the present invention are blocks of three types that include: hexahedral upper and lower frames and pillars respectively having a plurality of inward-facing protrusions; and small rails, curved rails and straight rails formed on a rail and respectively having insertion grooves which are formed at both ends of the outer face thereof and are firmly fit onto the protrusions. When the blocks are accumulated or joined with one another, the user can observe and see that the magnetic balls are rotated while moving according to their polarities. Furthermore, the user can enjoy playing with the block while observing a rolling state of the spherical balls or the magnetic balls inside the rails when the user properly assembles and connects the three types of the blocks to which the straight rails and the curved rails are assembled and inserts the spherical balls or the magnetic balls into the blocks.

Because the block according to the present invention having the regular hexahedral shape is joined to other block in such a fashion that the polarities of the magnetic balls are meet to attract mutually, when the blocks are joined together, the magnetic balls are freely rotated inside the hollow portions in such a fashion that the polarities of the magnetic balls are meet to attract mutually. Especially, the user can observe that the magnets embedded in the blocks are rolled by connecting and assembling the blocks having the small rails, the curved rails and the straight rails, whereby, the present invention can help to develop children's intelligence and creativity.

BRIEF DESCRIPTION OF DRAWINGS

FIG. 3 is a perspective view showing a state where the assembled block is joined to other assembled blocks on the front face, the left face, the upper face, and so on.

EXPLANATION OF ESSENTIAL REFERENCE NUMERALS IN DRAWINGS

Figure 1:
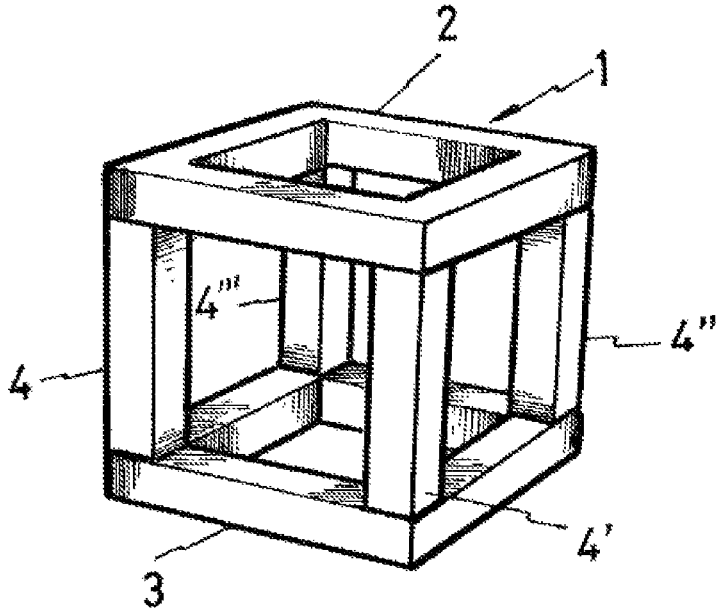
FIG. 1 is a perspective view showing a state where pillars are fit and assembled between upper and lower frames in such a way as to be a hexahedral block.
Figure 2:
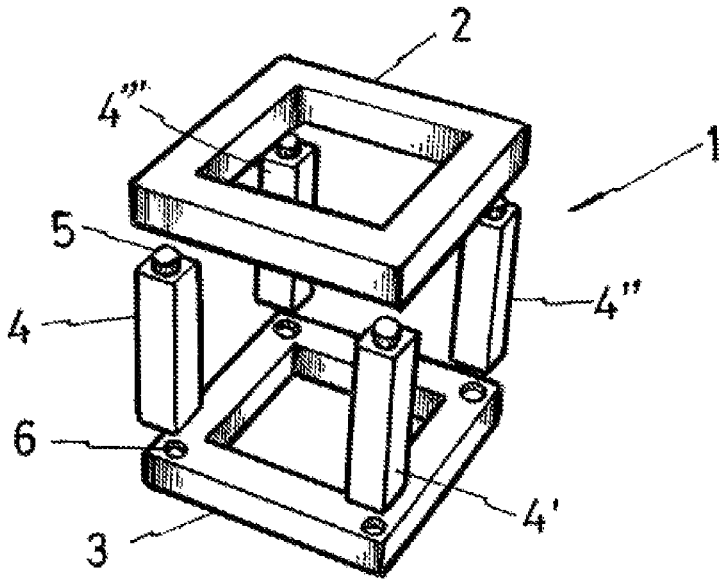
FIG. 2 is a perspective view showing a state before the pillars are fit and assembled between upper and lower frames.

1, 1', 1", 1'": block
2,20: upper frame
3,30: lower frame
4,4',4", 4'", 40,41,42,43: pillar
5,50: upper and lower protrusions
6,60: insertion aperture
7: hollow portion
8: magnetic ball (spherical magnet)
8*a*: spherical magnet
9,9': small rail 11,11': lower rail curved rail)
9*a*,9*b*,11*a*,11*b*: upper and lower straight rail
21,22,23,24: inward-facing protrusion of upper frame
25,26,27,28,25',26',27',28': inward-facing protrusion of pillar
23',24',27',28',23*a*,23*b*,28*a*,28*b*': rail insertion groove

DETAILED DESCRIPTION OF THE INVENTION

An assembling toy block according to the present invention includes an insertion aperture 6 formed in each edge of each inner face of an upper frame 2 and a lower frame 3 of a hexahedral body, a hollow portion 7 formed below the insertion aperture 6, and a magnetic ball 8 (spherical magnet) inserted and mounted into the hollow portion 7. Next, protrusions projectingly formed on upper and lower ends of four pillars 4, 4', 4" and 4'", and are inserted and assembled into the insertion apertures 6. The protrusions projectingly formed at the upper and lower ends of the four pillars are inserted and assembled into the insertion apertures 6 of the edges of the upper and lower frames 2 and 3, and before the protrusions are inserted and assembled into the insertion apertures 6, magnetic balls 8 are respectively inserted into the hollow portions 7.

Figure 3:
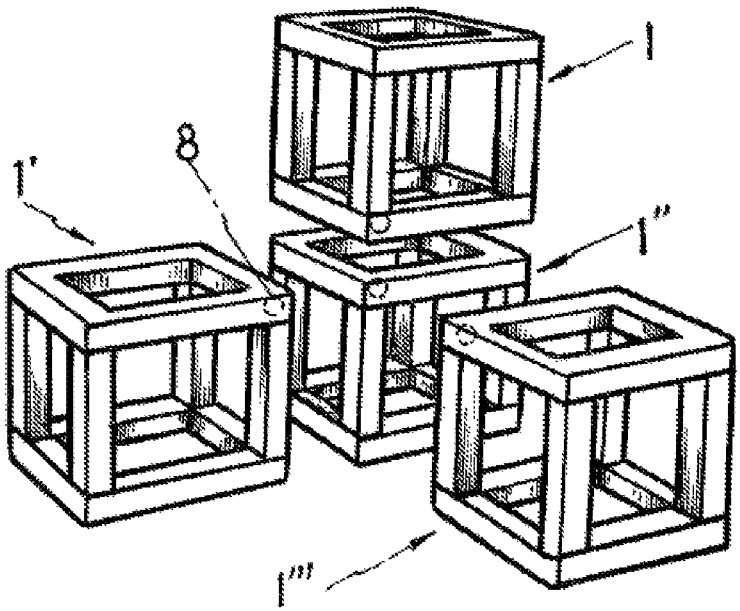
Figure 4:
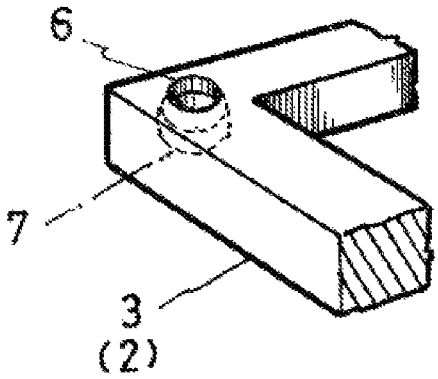
FIG. 4 is a partially enlarged perspective view showing an insertion aperture formed at each edge of the lower frame (also the upper frame), in which the dotted lines designate hollow portions in each of which a magnetic ball is inserted.
Figure 5:
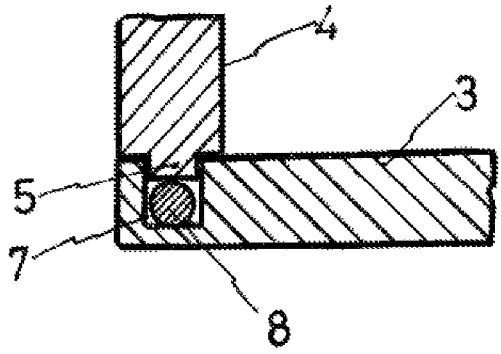
FIG. 5 is an enlarged sectional view showing a state where the magnetic ball is inserted into the hollow portion below the insertion aperture of the lower plate and the pillar is assembled.

In this instance, when the protrusion 5 projectingly formed on the upper and lower ends of the pillars are respectively inserted into the insertion apertures 6, they must be assembled not to touch the magnetic balls 8 and not to prevent the magnetic balls 8 from freely moving inside the hollow portions 7. When the components are assembled as described above, the assembled shape is illustrated in FIG. 1. When the assembled block is used, as shown in FIG. 3, when a block 1" is connected beneath a block 1 and a block 1' and a block 1" are connected to the left side and the front side of the block 1", the magnetic balls 8 inserted and fit into the hollow portions 7 of the edges are moved in such a fashion that polarities of the magnetic balls 8 meet to attract mutually, such that the blocks are joined together, and hence, the infant or children can make a wanted shape using the blocks.

Moreover, as shown in FIGS. 6 to 13, the upper frame 20, the lower frame 30, and the four pillars 40, 41, 42 and 43 respectively have inward-facing protrusions 21, 22, 23, 25, 26, 27 and 28 projectingly formed on inner faces thereof, and the protrusions are respectively fit and assembled into insertion grooves formed in rails, and thereby, the block according to the present invention is completed.

Figure 6:
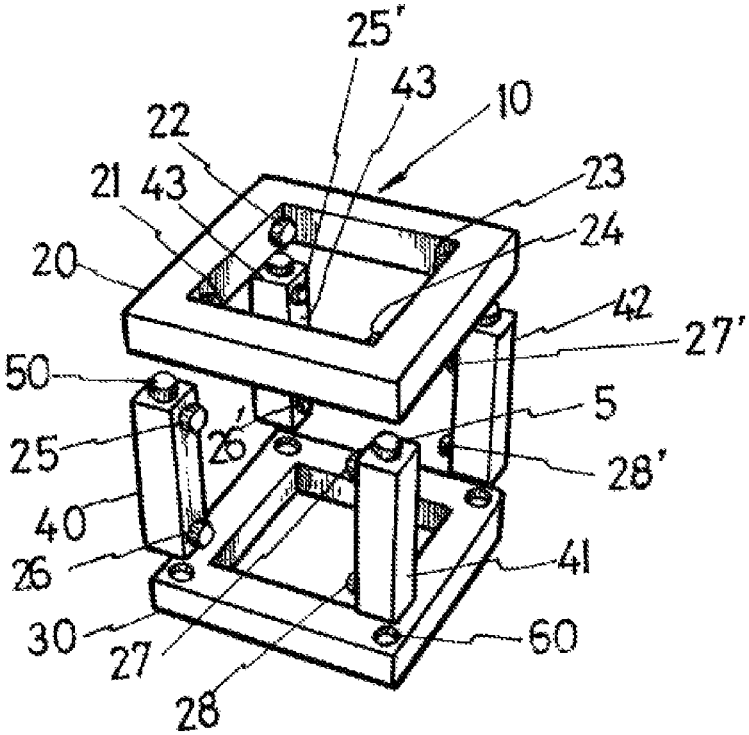
FIG. 6 is a perspective view showing a state where a block having protrusions projectingly formed is assembled.
Figure 7:
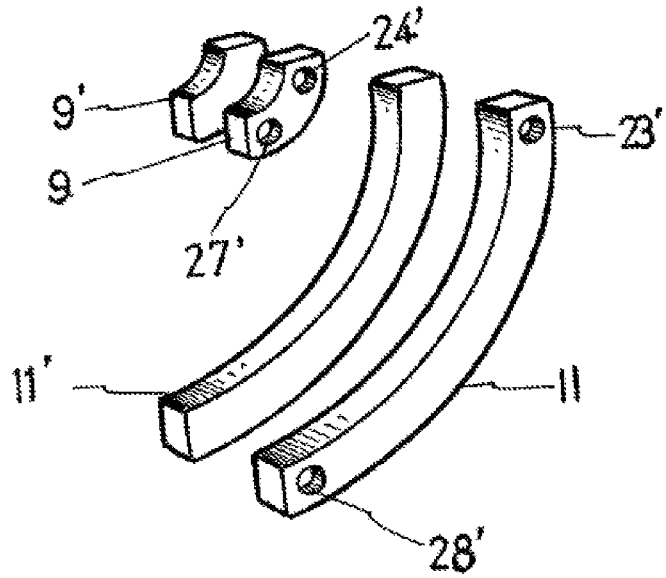
FIG. 7 is a perspective view of rails formed to be fit to the protrusions of the block of FIG. 6.
Figure 8:
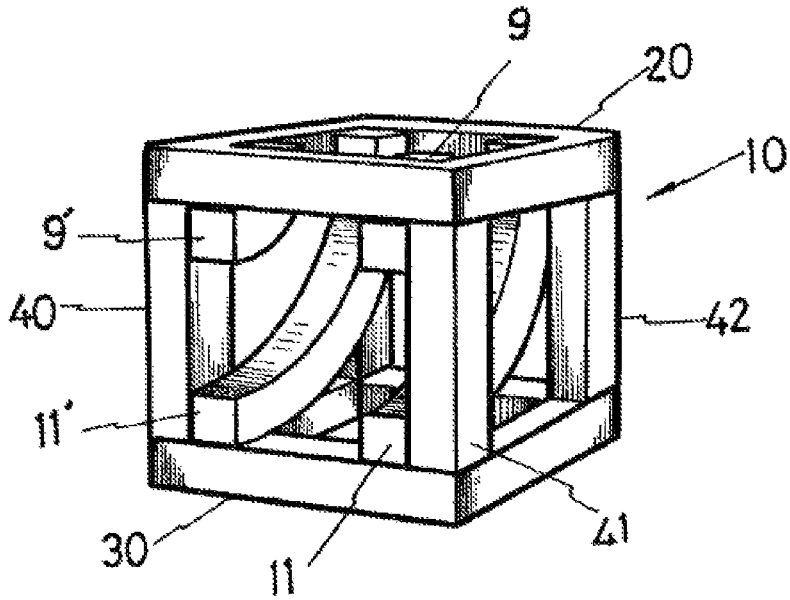
FIG. 8 is a perspective view of the block in which the rails are assembled.

Small rails 9 and 9' and lower rails 11 and 11' illustrated in FIG. 7 are used for constructing the block 10 illustrated in FIGS. 6 and 8. In FIG. 6, after upper and lower protrusions 50 of the pillars 40, 41, 42 and 43 are fit and assembled into insertion apertures 60 of the upper and lower frames 20 and 30, and then, rail insertion grooves 24' of both sides of the small rails 9 and 9' are respectively fit onto inward-facing protrusions 21 and 24 of the upper frame 20 and rail insertion grooves 27' of the small rails 9 and 9' are respectively fit and assembled onto upper inward-facing protrusions 25 and 27 of the pillars 40 and 41. Furthermore, rail grooves 23' of both sides of each upper portion of the lower rails 11 and 11' are respectively fit onto the inward-facing protrusions 22 and 23 of the upper frame 20, and insertion grooves 28' of the lower rails are respectively fit onto the inward-facing protrusions 26 and 28 of the lower portion of the pillars 40 and 41, such that the block according to the present invention is completely assembled as shown in FIG. 8.

Figure 9:
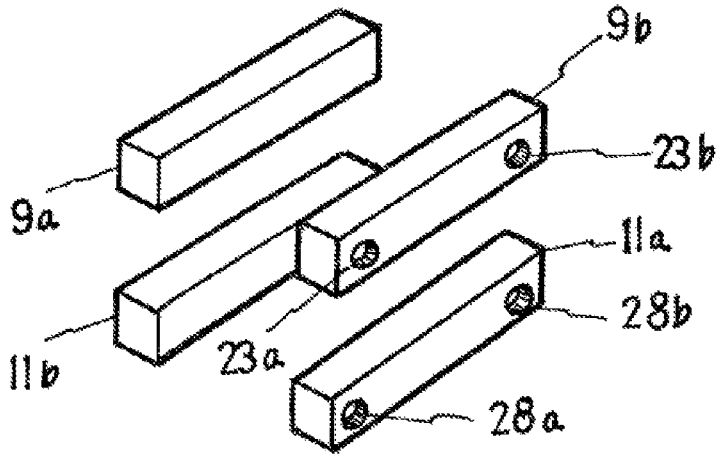
FIG. 9 is a perspective view of straight rails assembled to the block according to the present invention.
Figure 10:
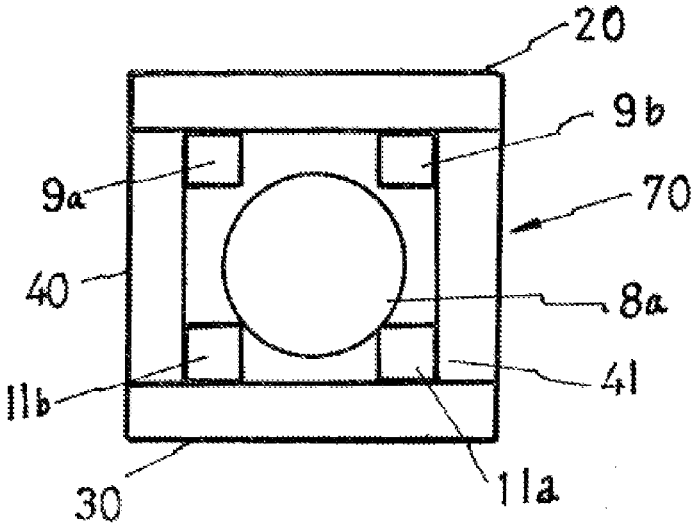
FIG. 10 is an exemplary view showing a state where the straight rails are fit to the block of the present invention and a ball is rollably positioned on the rails.

Additionally, the straight rails 9*a*, 9*b*, 11*a* and 11*b* illustrated in FIG. 9 respectively include rail insertion grooves 23*a*, 23*b*, 28*a* and 28*b* outwardly formed at both ends of each straight rail, and they will be described referring to FIG. 6. The insertion grooves 23*a* and 23*b* formed in the outward faces of the straight rails 9*a* and 11*b* are fit and assembled onto upper and lower inward-facing protrusions 25 and 25' and 26 and 26' of the pillars 40 and 43, and the insertion grooves 23*a* and 23*b* and 28*a* and 28*b* outwardly formed at both ends of the straight rails 9*b* and 11*a* are respectively fit and assembled onto the inward-facing protrusions 27, 27', 28 and 28' of the pillars 41 and 42, such that the block according to the present invention is completely assembled as shown in FIG. 10.

Figure 11:
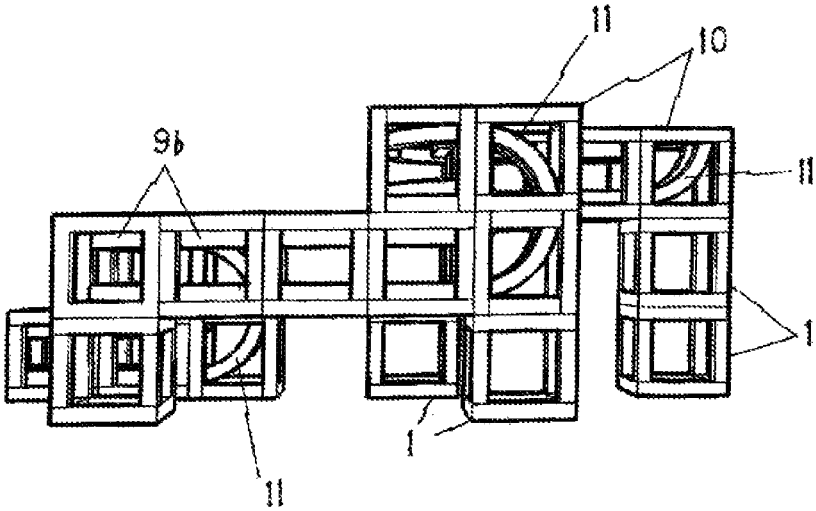
FIG. 11 is a side view showing a used state of the assembled block according to the present invention.
Figure 12:
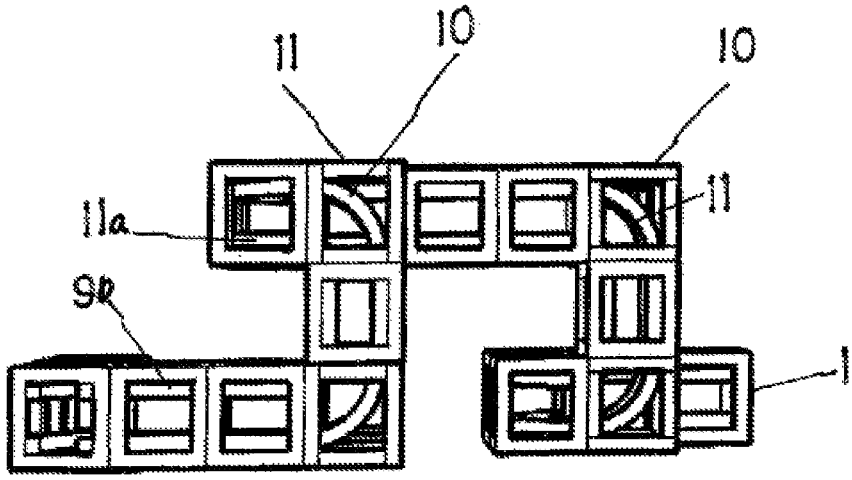
FIG. 12 is a plan view showing the used state of the assembled block according to the present invention.
Figure 13:
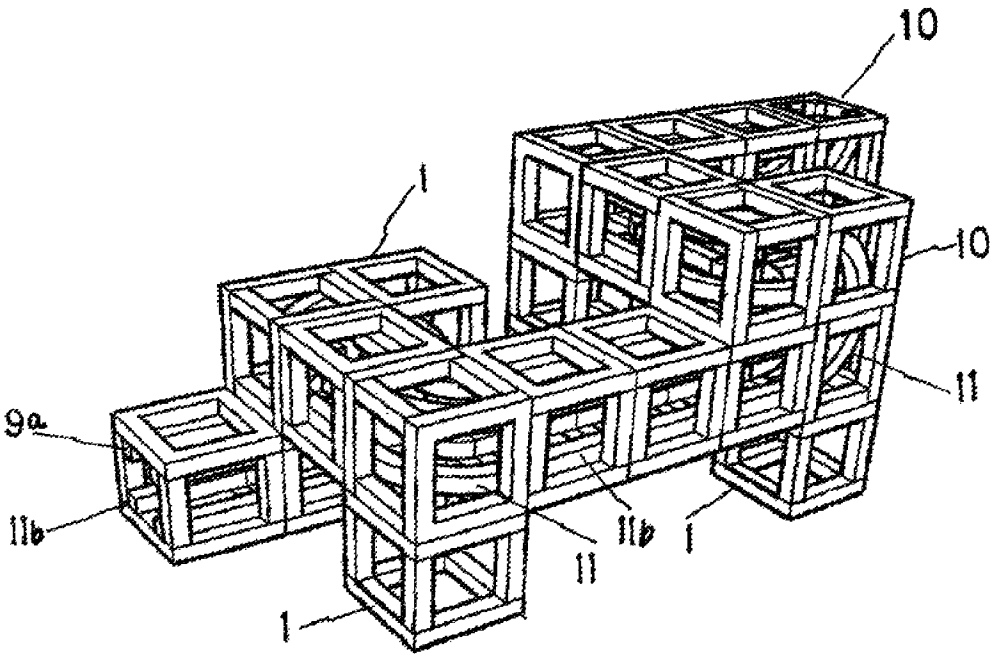
FIG. 13 is a perspective view showing the used state of the assembled block according to the present invention.

The completely assembled blocks 1, 10 and 70 may be assembled as illustrated in FIG. 3, but may be assembled as shown in the side view of FIG. 11, the plant view of FIG. 12, and the perspective view of FIG. 13 by properly mixing the blocks 1, 10 and 70. Besides the above, the blocks according to the present invention may be assembled and accumulated through various changes in shape and form. As shown in FIGS. 10, 11 to 13, After assembly, the magnetic balls or spherical balls 8*a* may be rollably mounted on the rails 9, 9', 11, 11', 9*a*, 9*b*, 11*a* and 11*b*, so that they can be utilized as various kinds of toys or teaching tools.

As described above, the assembling toy block according to the present invention may include the straight rails, curved rails, two-way separable rails, 4-way separable rails, a supporter, and so on. The length of rails assembled to each block is made in such a fashion that a way of the magnetic ball can be connected in four directions, and the magnetic ball is embedded in each of eight edges in such a fashion that the block can be joined to any face of another block when the blocks are joined to each other and in such a way as to freely roll to meet polarity to attract other magnetic ball when the block is joined to other block.

The invention claimed is:

1. An assembling toy block with embedded magnets, comprising:

Insertion apertures (6) inwardly formed at each of four edges of an upper frame (2) and a lower frame (3);

Hollow portions formed below the insertion apertures (6);

Magnetic balls (8) respectively inserted into the hollow portions (7);

Protrusions (5) respectively formed at upper and lower ends of four pillars (4, 4', 4" and 4'") and inserted into the insertion apertures (6), such that the block whose each face is formed in a square is completely assembled.

2. An assembling toy block with embedded magnets, comprising:

inward-facing protrusions (21,22,23,24) projectingly formed on the inner faces of an upper frame (20) and a lower frame (30);

upper and lower protrusions (25,26,27 and 28) and (25', 26',27' and 28') projectingly formed on the inner faces of pillars (40, 41, 42, 43);

small rails (9,9'), curved rails (11,11') and straight rails (9*a*,9*b*,11*a*,11*b*) respectively having rail insertion grooves (23',24',27' and 28') and (23*a*,23*b*,28*a* and 28*b*) formed in the outer faces thereof, Wherein the rail insertion grooves (23',24',27' and 28') and (23*a*,23*b*,28*a* and 28*b*) are fit and assembled onto the upper and lower protrusions (25,26,27 and 28) and (25', 26',27' and 28') to form an assembling block (10,70), so that user can enjoy assembling the blocks in various shapes and forms by accumulating and assembling them with each other in various manners.

* * * * *